US011397050B2

(12) United States Patent
Yu

(10) Patent No.: US 11,397,050 B2
(45) Date of Patent: Jul. 26, 2022

(54) SOFTGEL DRYING MACHINE

(71) Applicant: Xiongqing Yu, Diamond Bar, CA (US)

(72) Inventor: Xiongqing Yu, Diamond Bar, CA (US)

( * ) Notice: Subject to any disclaimer, the term of this patent is extended or adjusted under 35 U.S.C. 154(b) by 220 days.

(21) Appl. No.: 16/714,655

(22) Filed: Dec. 13, 2019

(65) Prior Publication Data

US 2020/0355433 A1 Nov. 12, 2020

(30) Foreign Application Priority Data

May 7, 2019 (CN) ..... 201910374329.7

(51) Int. Cl.
*F26B 17/10* (2006.01)
*F26B 25/02* (2006.01)

(52) U.S. Cl.
CPC ..... *F26B 17/106* (2013.01); *F26B 25/02* (2013.01)

(58) Field of Classification Search
CPC ..... F26B 17/106; F26B 17/30; F26B 17/32; F26B 25/02; F26B 11/028; F26B 11/04; F26B 11/022; F26B 21/086; F26B 21/083; F26B 21/04; F26B 11/0436; F26B 21/004; F26B 25/002
See application file for complete search history.

(56) References Cited

U.S. PATENT DOCUMENTS

| | | | | |
|---|---|---|---|---|
| 8,621,764 | B2 * | 1/2014 | Puckett | A23L 29/284 34/443 |
| 9,638,464 | B2 * | 5/2017 | Puckett | F26B 11/0436 |
| 10,001,322 | B2 * | 6/2018 | Puckett | F26B 11/0445 |
| 10,677,528 | B2 * | 6/2020 | Puckett | H05K 999/99 |
| 10,809,004 | B1 * | 10/2020 | Puckett | F26B 21/10 |
| 2009/0235550 | A1 * | 9/2009 | Fluegge | D06F 31/00 34/127 |

* cited by examiner

*Primary Examiner* — Jessica Yuen
(74) *Attorney, Agent, or Firm* — Tommy S F Wang; Wang IP Law Group, P.C.

(57) ABSTRACT

The softgel drying machine comprises a casing, first tumblers, second tumblers, a pneumatic conveying device and a air-drying system. The casing comprises a air generation chamber and a air circulation chamber. The air circulation chamber comprises a first circulation chamber and a second circulation chamber, at least one first drying chamber is located at the first circulation chamber, at least one second drying chamber is located at the second circulation chamber, the first drying chamber comprises a first air inlet and a first air outlet, the second drying chamber comprises a second air inlet and a second air outlet. The first tumblers are located at the first circulation chamber. The second tumblers are located at the second circulation chamber. The air-drying system is located at the air generation chamber and comprises a blower fan, an air return duct and an air supply port.

19 Claims, 4 Drawing Sheets

SOFTGEL DRYING MACHINE

CROSS-REFERENCE TO RELATED APPLICATION

This application claims priority benefit from China Patent Application No. 201910374329.7, filed on May 7, 2019 in the State Intellectual Property Office of the P.R.C, the disclosure of which is incorporated herein by reference in its entirety.

TECHNICAL FIELD OF THE INVENTION

The present application is related to the field of drying machine, and more specifically, to softgel drying machine.

BACKGROUND OF THE INVENTION

It is necessary to use an air-drying system with a tumbler to air-dry the softgel when manufacturing a softgel. However, current softgel drying machine are all single in-line, limiting softgels production throughput. In addition, during high volume production, populating the softgels inside the holding tumbler may increase the tendency for the softgel to bombard inside the tumbler. As such, the softgels are easily to be broken, increasing the chance for the softgels to stick together, and/or hindering the aesthetic of the softgel finish product. Therefore, it is not conducive either for fine production or for resource conservation.

Evidently, a need remains for a softgel drying machine to provide a multi-line for more efficient, faster production, and reduction in product defect for high volume production.

SUMMARY OF THE INVENTION

The present application discloses a softgel a multi-line drying machine to provide faster and more efficient softgel drying.

The softgel drying machine comprises a casing, a plurality of first tumblers, a plurality of second tumblers, a pneumatic conveying device and an air-drying system.

The casing comprises an air generation chamber and an air circulation chamber, wherein the air circulation chamber comprises a first circulation chamber and a second circulation chamber, at least one tumbler is located at the first circulation chamber, at least one second tumbler is located at the second circulation chamber, totaling of four tumbler per unit. The first drying chamber comprises a first air inlet and a first air outlet, the second drying chamber comprises a second air inlet and a second air outlet.

The plurality of first tumblers is disposed for reversing softgels, wherein the plurality of first tumblers is located at the first circulation chamber.

The plurality of second tumblers is disposed for reversing softgels, wherein the plurality of second tumblers is located at the second circulation chamber.

The pneumatic conveying device is coupled to the air circulation chamber.

The air-drying system is located at the air generation chamber and comprises a blower fan, an air return duct and an air supply port. The blower fan is coupled to the air circulation chamber. The air return duct is coupled to the blower fan. The air supply port is coupled to the first air inlet and the second air inlet.

In various exemplary embodiments, wherein the softgel drying machine comprises a pair of the first tumblers and a pair of the second tumblers. The air circulation chamber comprises a pair of the first drying chambers and a pair of the second drying chambers, wherein one of the first tumbler is located at one of the first drying chamber correspondingly, and one of the second tumbler is located at one of the second drying chamber correspondingly.

In various exemplary embodiments, wherein the air circulation chamber further comprises an empty chamber located between the first circulation chamber and the second circulation chamber. One side surface of the first drying chamber close to the empty chamber is a semi-cylindrical surface. The first air inlet is located at a lower side of the semi-cylindrical surface of the first drying chamber, and the first air outlet is located at an upper side of the semi-cylindrical surface of the first drying chamber.

In various exemplary embodiments, wherein the air circulation chamber further comprises an empty chamber located between the first circulation chamber and the second circulation chamber. One side surface of the first drying chamber close to the empty chamber is a semi-cylindrical surface. One side surface of the second drying chamber close to the empty chamber is a semi-cylindrical surface. The second air inlet is located at a lower side of the semi-cylindrical surface of the second drying chamber, and the second air outlet is located at an upper side of the semi-cylindrical surface of the second drying chamber.

In various exemplary embodiments, wherein the first tumblers in the first circulation chamber is coaxially disposed. The second tumblers in the second circulation chamber is coaxially disposed as well.

In various exemplary embodiments, wherein each of the first tumbler comprises a first tumbler inlet, and each of the second tumbler comprises a second tumbler inlet. The pneumatic conveying device comprises a first conveying pipe and a second conveying pipe, the first conveying pipe is coupled to the first tumblers by passing through the first tumbler inlets, and the second conveying pipe is coupled to the second tumblers by passing through the second tumbler inlets.

In various exemplary embodiments, the softgel drying machine further comprises a cold air supply duct and an air supply duct. The cold air supply duct is located at the air circulation chamber, the cold air supply duct is coupled to the first air supply opening and the second air supply opening. An installation direction of the cold air supply duct is the same as an axial direction of the first tumblers and the second tumblers. The air supply duct is coupled to the cold air supply duct and the air supply port of the air-drying system.

In various exemplary embodiments, wherein the air-drying system further comprises an evaporator coupled to the air supply port.

In various exemplary embodiments, wherein the air-drying system further comprises a dehumidification module coupled to the air supply port.

In various exemplary embodiments, the soft gel drying machine further comprises a first tumbler motor coupled to the plurality of first tumblers.

In various exemplary embodiments, the soft gel drying machine further comprises a second tumbler motor coupled to the plurality of second tumblers.

In various exemplary embodiments, wherein each of the first tumbler comprises a first tumbler body and a first tumbler mesh located at the tumbler body, and each of the second tumbler comprises a second tumbler body and a second tumbler mesh located at the second tumbler body.

Based on the above, the softgel drying machine of the present application allows the user to dry softgels faster. In addition, the coaxial layout of the first tumblers and the second tumblers may also increase the efficiency when manufacturing since the pneumatic conveying device may convey the softgels at a same production line.

Furthermore, the empty chamber decreases the air moving space, making the air to pass through the air outlet faster and thus improve the overall efficiency. Moreover, the resource can be saved since one pneumatic conveying device can be shared with two rows of tumblers.

Numerous other advantages and features of the present application will become readily apparent from the following detailed description of disclosed embodiments, from the claims and from the accompanying drawings.

BRIEF DESCRIPTION OF THE DRAWINGS

The objects, features and advantages of the present application will be more readily appreciated upon reference to the following disclosure when considered in conjunction with the accompanying drawings, wherein like reference numerals are used to identify identical components in the various views, and wherein reference numerals with alphabetic characters are utilized to identify additional types, instantiations or variations of a selected component embodiment in the various views, in which.

DETAILED DESCRIPTION OF DISCLOSED EMBODIMENTS

Figure 1:
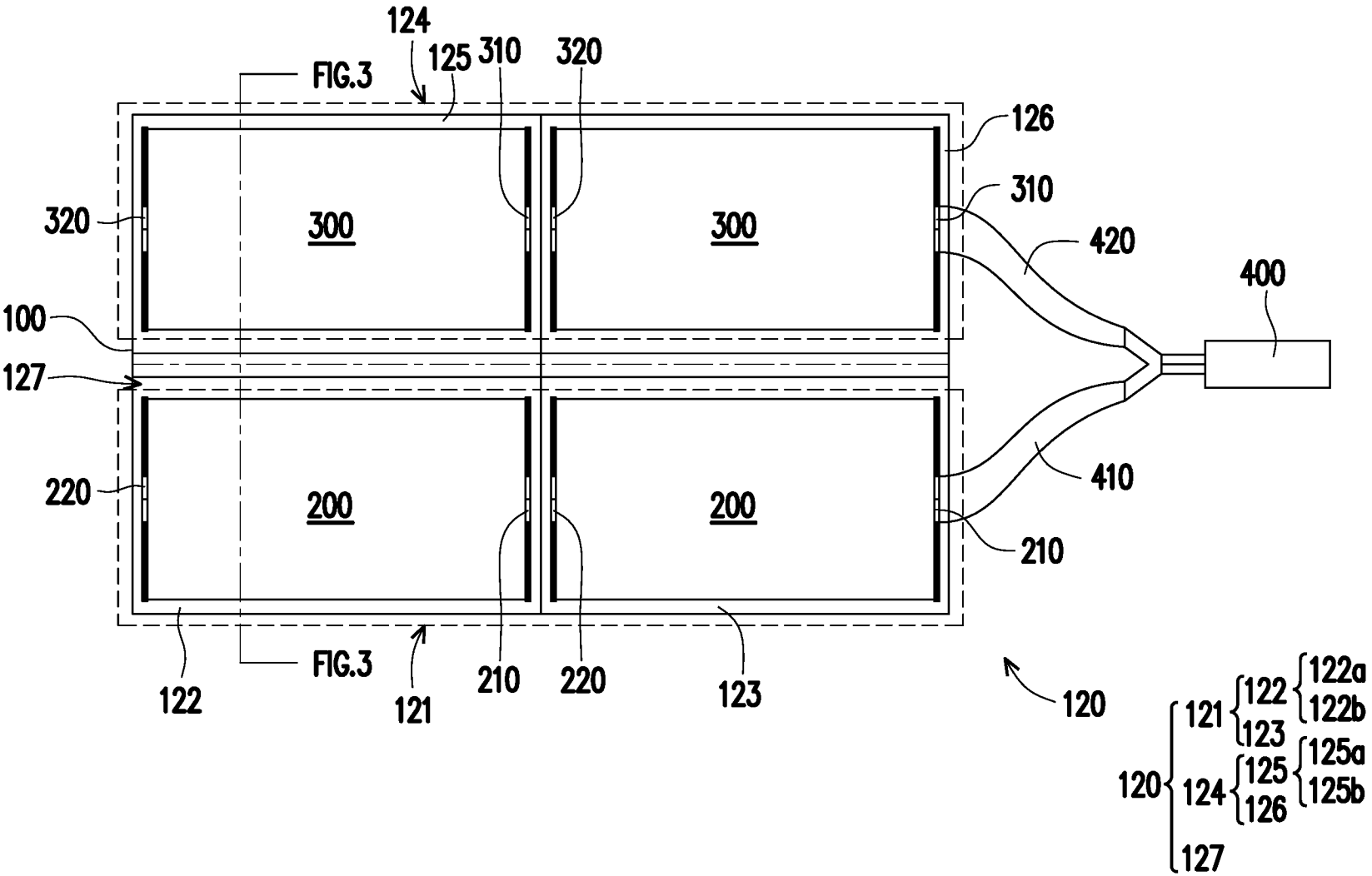
FIG. 1 is a top view showing a softgel drying machine of the present application.

Reference will now be made in detail to the present representative embodiments of the present application, examples of which are illustrated in the accompanying drawings. Wherever possible, the same reference numbers are used in the drawings and the description to refer to the same or like parts.

Figure 2:
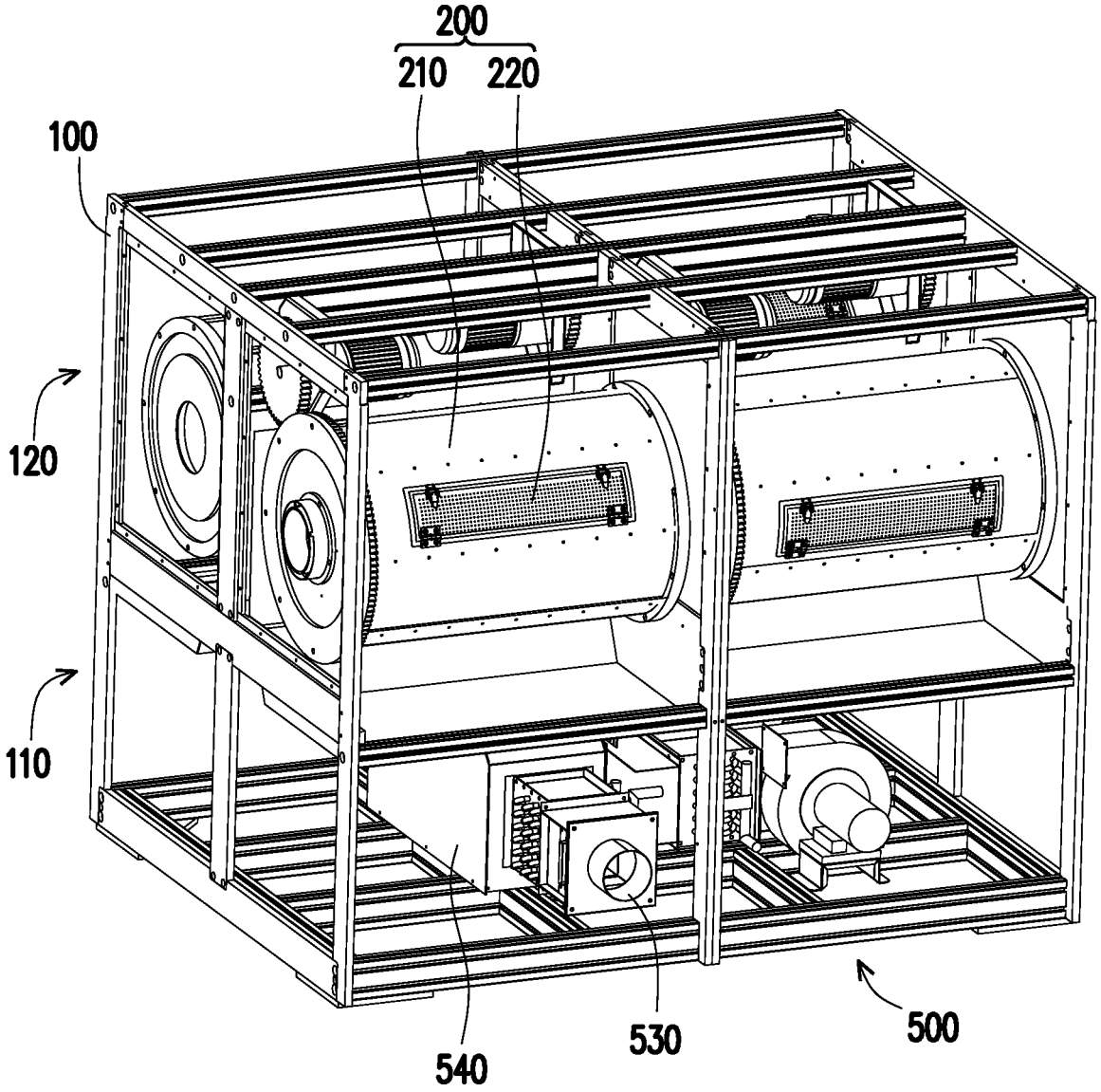
FIG. 2 is a view showing the softgel drying machine of the present application with part of a casing, surface of drying chambers and air return ducts being removed.

FIG. 1 is a top view showing a softgel drying machine of the present application. FIG. 2 is a view showing the softgel drying machine of the present application with part of a casing 100, surface of drying chambers 122/123/125/126 and air return ducts 520 being removed.

Figure 3:
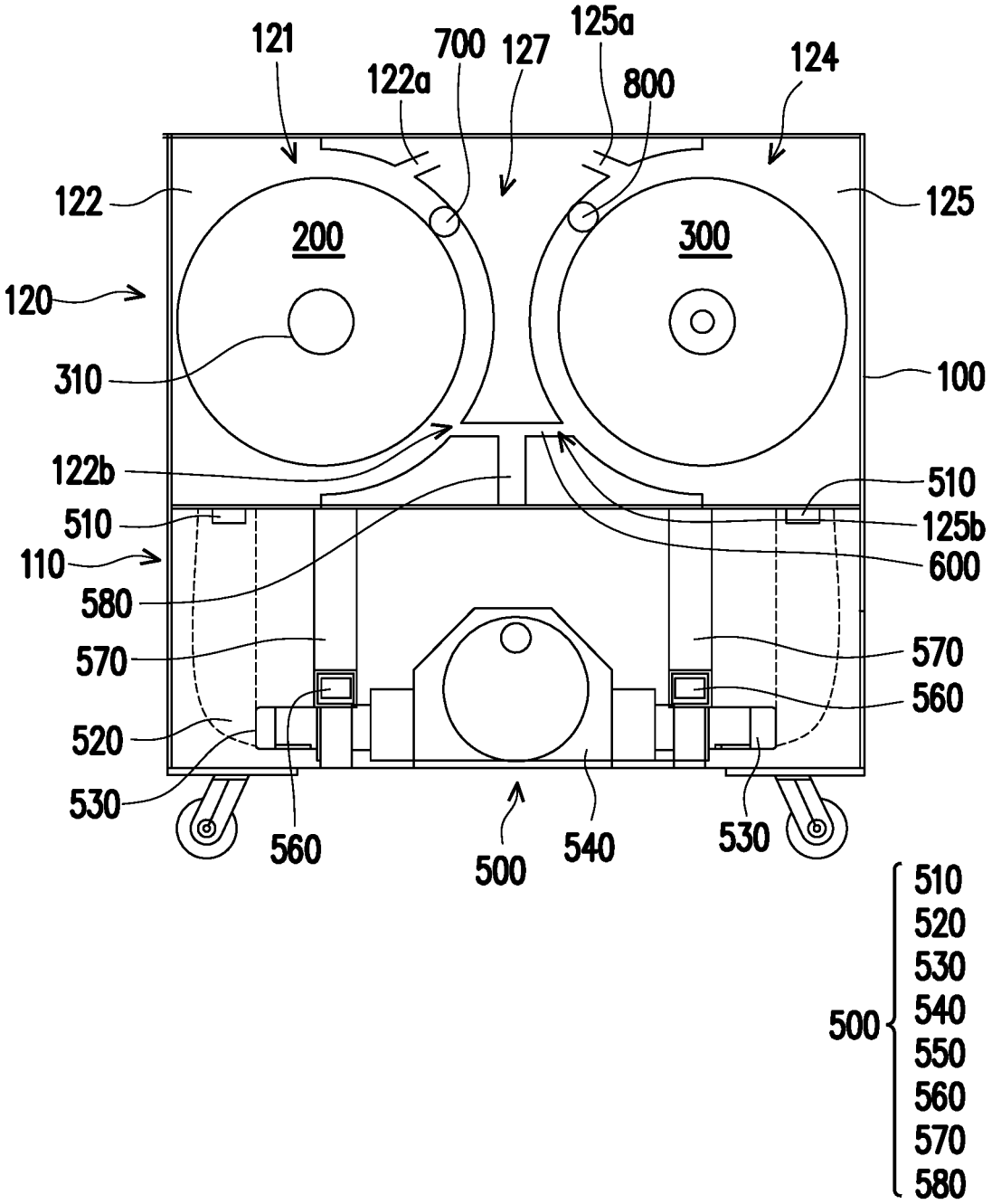
FIG. 3 is a cross-section view of the softgel drying machine of the present application along line FIG. 3-FIG. 3 in FIG. 1.
Figure 4:
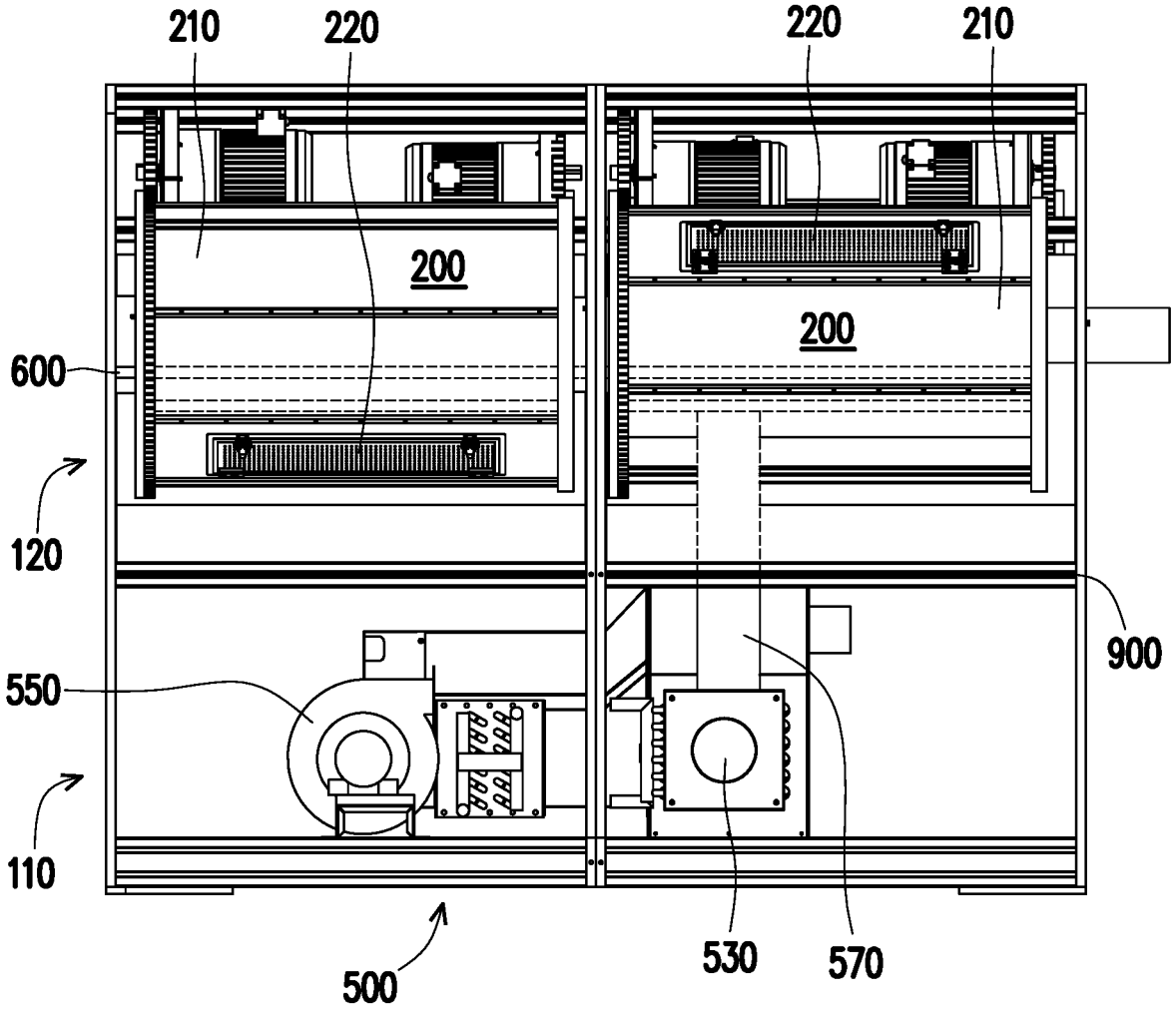
FIG. 4 is a front view showing the softgel drying machine of the present application with part of the casing, the surface of the drying chambers and the air return ducts being removed.

The softgel drying machine of the present application comprises a casing 100, a plurality of first tumblers 200, a plurality of second tumblers 300, a pneumatic conveying device 400, an air-drying system 500, a cold air supply duct 600 (referring to FIGS. 3-4), a first tumbler motor 700 (referring to FIG. 3), a second tumbler motor 800 (referring to FIG. 3) and a sealing partition (referring to FIG. 4).

As shown in FIGS. 1-2, the casing 100 comprises an air generation chamber 110 and an air circulation chamber 120. The air generation chamber 110 is located at lower side compared to the air circulation chamber 120 in the present application only as an example. The air-drying system 700 is located at the air generation chamber 110.

The air circulation chamber 120 comprises a first circulation chamber 121 and a second circulation chamber 124. The first circulation chamber 121 is located next to and parallel to the second circulation chamber 124. The first circulation chamber 121 comprises at least one first drying chamber 122/123 and the second circulation chamber 124 comprises at least one second drying chamber 125/126. In the present application, there are two first drying chambers 122/123 connected end to end and two second drying chambers 125/126 connected end to end as an example. As such, there are four drying chambers 122/123/125/126 in the softgel drying machine of the present application. In addition, the first drying chamber 122 and the first drying chamber 123 are independent and the second drying chamber 125 and the second drying chamber 126 are air independent as an example. However, the present application is not limited thereto, the first drying chambers 122/123 at the first circulation chamber 121 and the second drying chambers 125/126 at the second circulation chamber 124 may be mutually independent, and may also be connected to each other. In the present application, the first drying chambers 122/123 and the second drying chambers 125/126 are mutually independent, which is advantageous for independent operation of different tumblers 200/300.

As such, one of the first tumbler 200 is located at the first drying chamber 122 while another one of the first tumbler 200 is located at the first drying chamber 123. Similarly, one of the second tumbler 300 is located at the second drying chamber 125 while another one of the second tumbler 300 is located at the second drying chamber 126.

The two first tumblers 200 in the first circulation chamber 121 are coaxially disposed in the corresponding drying chambers 122/123. The two second tumblers 300 in the second circulation chamber 124 are coaxially disposed in the corresponding drying chambers 125/126. The coaxially structure is more beneficial for the pneumatic conveying device 400 to convey the softgels. However, it should be noted that the first tumblers 200 and the second tumblers 300 can be set in any direction and any position, as long as the softgels can be dried.

The first tumbler 200 and the second tumbler 300 are the same in the present application as an example. However, the shape, size or overall structure etc. may be different as long as the tumblers can dry the softgels. The following description utilizes the first tumbler 200 as an example. The related description can be applied to the second tumblers 300 as well.

The tumbler 200 comprises a tumbler body 210 and a tumbler mesh 220. The tumbler mesh 220 is located at the tumbler body 210. Specifically, an opening is located at the tumbler body 210 while the tumbler mesh 220 covers the opening. As such, the air may flow in and out the tumbler 200 via the tumbler mesh 220 without dropping out. The first tumbler 200 comprises a first tumbler inlet 210 and the first tumbler outlet 220. The first tumbler inlet 210 and the first tumbler outlet 220 are located at the center of the corresponding sides of the first tumbler 200. The second tumbler 300 comprises a second tumbler inlet 310 and the second tumbler outlet 320. The second tumbler inlet 310 and the second tumbler outlet 320 are located at the center of the corresponding sides of the second tumbler 300. The above structure is better to facilitate feeding the softgels into the tumblers 200/300.

The pneumatic conveying device 400 is communicated with the air circulation chamber 120 for conveying softgels. Specifically, the pneumatic conveying device 400 comprises a first conveying pipe 410 and a second conveying pipe 420. The first conveying pipe 410 is coupled to the first tumblers 200 via passing through the first tumbler inlets 210. The second conveying pipe 420 is coupled to the second tumblers 300 via passing through the second tumbler inlets 310.

The pneumatic conveying device 400 of the present application can be any type of device, such as a common conveyor belt motor, a numerical control motor, etc., as long as the softgels can be conveyed into the first tumblers 200 and the second tumblers 300. In the present application as an example, the pneumatic conveying device 400 use a pneumatic control divider to switch the divider from side to side at a set time interval to divert flow of the product between the first two tumblers, which is more conducive to distribute the softgels evenly between the first two tumblers. In comparing to a single line dryer, this multi-line dryer divides the softgel into two tumbler allowing more space softgel to move, less bombardment, easier for air to flow to dry the softgel and thereby improving the production efficiency, product through put with less defect.

It should be noted that the transportation of the softgels may be in any manner. The softgel drying machine of the present application utilizes the form of a transport pipe. The softgels are blown into the tumblers 200/300 by the pneumatic conveying device 400 through the transport pipe to prevent the softgels from adhering to the transport pipe.

Initially, the pneumatic conveying device 400 conveyed the softgel into one of the first tumbler 200. The first tumbler 200 is driven by a first tumbler motor 700 (referring to FIG. 3) and rotate constantly during each drying stage. When the softgels are ready to be unloaded, the first tumblers 200 will rotate in reverse conveying the softgel to the another first tumbler 200 in the series. The same concept can be utilized for the second tumblers 300. It should be noted that multiple softgel drying machine can be connected to each other for additional tumblers if need. In this case, each drying chamber 122/123/125/126 is connected to a build-in air-drying system that continuous recirculate high velocity dried cold air inside the drying chamber 200 and the tumbler 500 to dry the softgel.

The present application is not limited in the amount of the softgel drying machine units connecting together. That is to say, the third, fourth etc. of the softgel drying machine may also be utilized if necessary, depending on production demand FIG. 3 is a cross-section view of the softgel drying machine of the present application along line FIG. 3-FIG. 3 in FIG. 1. FIG. 4 is a front view showing the softgel drying machine of the present application with part of the casing 100, the surface of the drying chambers 122/123/125/126 and the air return ducts 520 being removed.

As shown in FIG. 3, the empty chamber 127 is disposed between the first circulation chamber 121 and the second circulation chamber 125. One side surface of the first drying chamber 122 close to the empty chamber 127 is a semi-cylindrical surface. In addition, an upper side of the semi-cylindrical surface of the first drying chamber 122 is provided with a first air outlet 122*a* for discharging return air in the first drying chamber 122. A lower side of the semi-cylindrical surface of the first drying chamber 122 is provided with a first air inlet 122*b* for inputting dry cold air. The above structure can be applied to the first drying chamber 123 (referring to FIG. 1).

Similarly, one side surface of the second drying chamber 125 close to the empty chamber 127 is a semi-cylindrical surface. In addition, an upper side of the semi-cylindrical surface of the second drying chamber 125 is provided with a second air outlet 125*a* for discharging return air in the second drying chamber 125. A lower side of the semi-cylindrical surface of the second drying chamber 125 is provided with a second air inlet 125*b* for inputting dry cold air. The above structure can be applied to the second drying chamber 126 (referring to FIG. 1).

It can be understood that one side of the drying chambers 122/123/125/126 close to the empty chamber 127 may be a surface of any shape, such as a square shape or a circular arc shape. In the present application as an example, the drying chambers 122/123/125/126 comprises a semi-cylindrical surface, which can be consistent with the tumblers 200/300, and is more convenient for equipment installation and maintenance.

It should be noted that the number of the first air outlet, the first air inlet, the second air outlet and the second air inlet may be any number, and may be adjusted according to the actual demands for the cold air.

In addition, it should be noted that the arrangement positions of the first air inlet, the first air outlet, the second air inlet and the second air outlet may be located at any position. In the present application as an example, the first air inlet 122*b* and the second air inlet 125*b* are disposed on the lower side, and the first air outlet 122*a* and the second air outlet 125*a* are disposed on the upper side, which is more favorable for the input and discharge of cold air and hot air since the air generation chamber 110 is located at the lower side compared to the air circulation chamber 120.

The first air inlet 122*b* and the second air inlet 125*b* in the present application are connected to each other via the cold air supply duct 600 for increasing the efficiency. However, the present application is not limited thereto as long as the cold air can be supplied to the first drying chambers 122/123 and the second drying chambers 125/126. The detail of the cold air supply duct 600 will be described later with FIG. 4.

As shown in FIGS. 3-4, the air-drying system 500 comprises at least one drying fan 510, at least one air return duct 520, at least one air return port 530, a dehumidification module 540, at least one evaporator 550, at least one air supply port 560, at least one air supply duct 570 and at least one air supply central duct 580.

Since the softgel drying machine comprises two air circulation chamber 121/124, the air-drying system 500 may comprise a pair of related components for drying and supplying the air. Specifically, the air-drying system 500 comprises a pair of drying fan 510, a pair of air return duct 520, a pair of air return port 530, a pair of evaporator 550, a pair of air supply port 560 and a pair of air supply duct 570. However, the present application is not limited thereto, the air-drying system 500 may comprise only one drying fan 510, one air return duct 520, one air return port 530, one evaporator 500, one air supply port 560 and one air supply duct 570 as long as the air can be cooled.

The blower fanblower fans 510 are utilized for driving the return air to blow to the air return ports 530 through the air return ducts 520.

The dehumidification module 540 is utilized for dehumidifying the return air. It should be noted that a filler in the dehumidification module 540 can be any material, as long as drying can be implemented. The dehumidification module 540 of the present application utilizes active silica gel as the filler, which has better drying effects, as an example.

The evaporators 550 are utilized for refrigerating the supply air. It should be noted that a common air-drying system usually has a surface cooler installed separately behind the air return port 530 and the dehumidification module 540 for refrigerating. However, since there is still a distance between the air supply port 560 and the surface cooler, it is easy to cause the temperature of the cold air temperature to change and the cold air with optimum temperature cannot be outputted. Therefore, the present application provides evaporators 550 within the air generation chamber 110 and near the air supply ports 560 to improve the quality of the cold air.

Finally, the cold air may pass the air supply ports 560 and the air supply ducts 570 to the air circulation chamber 120 via the air supply central duct 580.

Referring to FIGS. 3-4, the cold air supply duct 600 is utilized for conveying the dry cold air. The first air inlet 122*b* and the second air inlet 125*b* are communicated with the cold air supply duct 600. In addition, the air supply ports 560 are communicated with the cold air supply duct 600 through the air supply ducts 570 and the air supply central duct 580. An installation direction of the cold air supply duct 600 is the same as an axial direction of the tumblers 200/300.

It can be understood that the cold air supply duct 600 is a strip-shaped duct disposed along the transport direction of the softgels. In order to increase the amount of cold air, a plurality of air outlets may be disposed in the cold air supply duct 600 corresponding to the first air inlet 122*b* and the second air inlet 125*b*. The specific number can be adjusted according to actual production needs.

It can be understood that the number of the cold air supply duct 600 can be any number. The softgel drying machine of the present application comprises only one cold air supply duct 600 as an example.

The first tumbler motor 700 is coupled to the first tumblers 200. The second tumbler motor 800 is coupled to the second tumblers 300. The tumbler motors 700/800 are utilized for driving the corresponding tumblers 200/300. The first tumbler motor 700 is shared by two first tumblers 200 and the second tumbler motor 800 is shared by two second tumblers 300 as an example. However, the multiple first tumbler motor 700 and the multiple second tumbler motor 800 can be set up as well. The present application is not limited in the amount of the tumbler motor.

Referring to FIG. 4, the air generation chamber 110 and the air circulation chamber 120 may be communicated to each other or may be sealed. In the present application as an example, the sealing partition 900 is utilized to separate the air generation chamber 110 and the air circulation chamber 120 so as to ensure the airtightness in the air circulation chamber 120.

The sealing partition 900 is provided with an opening for communicating the air supply ducts 570. The air supply ducts 570 are penetrated through the sealing partition 900 and are communicated with the cold air supply duct 600. Airtighted connection is kept at a connected portion between the air supply ducts 570 and the sealing partition 900.

Based on the above, the softgel drying machine of the present application allows the user to dry multi-categories of softgels via providing double-row tumblers as the first tumblers and the second tumblers. In addition, the coaxial layout of the first tumblers and the second tumblers may also increase the efficiency when manufacturing since the pneumatic conveying device may convey the softgels at a same production line.

Furthermore, the empty chamber decreases the air moving space, making the air to pass through the air outlet faster and thus improve the overall efficiency. Moreover, the resource can be saved since one pneumatic conveying device can be shared with two rows of tumblers.

It will be apparent to those skilled in the art that various modifications and variations can be made to the structure of the present application without departing from the scope or spirit of the present application. In view of the foregoing, it is intended that the present application cover modifications and variations of this application provided they fall within the scope of the following claims and their equivalents.

What is claimed is:

1. A softgel drying machine comprising:

a casing comprising an air generation chamber and an air circulation chamber, wherein the air circulation chamber comprises a first circulation chamber and a second circulation chamber, at least one first drying chamber is located at the first circulation chamber, at least one second drying chamber is located at the second circulation chamber, the first drying chamber comprises a first air inlet and a first air outlet, the second drying chamber comprises a second air inlet and a second air outlet;

a plurality of first tumblers for reversing softgels, wherein the plurality of first tumblers is located at the first circulation chamber;

a plurality of second tumblers for reversing softgels, wherein the plurality of second tumblers is located at the second circulation chamber;

a pneumatic conveying device coupled to the air circulation chamber; and an air-drying system located at the air generation chamber, comprising:

a blower fan coupled to the air circulation chamber;

an air return duct coupled to the blower fan; and a cold air supply duct located at the air circulation chamber, the cold air supply duct is coupled to the first air inlet and the second air inlet.

2. The softgel drying machine as claimed in claim 1, wherein the softgel drying machine comprises a pair of the first tumblers and a pair of the second tumblers.

3. The softgel drying machine as claimed in claim 2, wherein the air circulation chamber comprises a pair of the first drying chambers and a pair of the second drying chambers, wherein one of the first tumbler is located at one of the first drying chamber correspondingly, and one of the second tumbler is located at one of the second drying chamber correspondingly.

4. The softgel drying machine as claimed in claim 1, wherein the air circulation chamber further comprises an empty chamber located between the first circulation chamber and the second circulation chamber.

5. The softgel drying machine as claimed in claim 4, wherein one side surface of the first drying chamber close to the empty chamber is a semi-cylindrical surface.

6. The softgel drying machine as claimed in claim 5, wherein the first air inlet is located at a lower side of the semi-cylindrical surface of the first drying chamber, and the first air outlet is located at an upper side of the semi-cylindrical surface of the first drying chamber.

7. The softgel drying machine as claimed in claim 5, wherein one side surface of the second drying chamber close to the empty chamber is a semi-cylindrical surface.

8. The softgel drying machine as claimed in claim 7, wherein the second air inlet is located at a lower side of the semi-cylindrical surface of the second drying chamber, and the second air outlet is located at an upper side of the semi-cylindrical surface of the second drying chamber.

9. The softgel drying machine as claimed in claim 1, wherein the first tumblers in the first circulation chamber are coaxially disposed.

10. The softgel drying machine as claimed in claim 9, wherein the second tumblers in the second circulation chamber are coaxially disposed.

11. The softgel drying machine as claimed in claim 1, wherein each of the first tumbler comprises a first tumbler inlet, and each of the second tumbler comprises a second tumbler inlet.

12. The softgel drying machine as claimed in claim 11, wherein the pneumatic conveying device comprises a first conveying pipe and a second conveying pipe, the first conveying pipe is coupled to the first tumblers by passing through the first tumbler inlets, and the second conveying pipe is coupled to the second tumblers by passing through the second tumbler inlets.

13. The softgel drying machine as claimed in claim 1, further comprising an air supply duct coupled to the cold air supply duct and an air supply port of the air-drying system.

14. The softgel drying machine as claimed in claim 1, wherein an installation direction of the cold air supply duct is the same as an axial direction of the first tumblers and the second tumblers.

15. The softgel drying machine as claimed in claim 1, wherein the air-drying system further comprises an evaporator coupled to the air supply port.

16. The softgel drying machine as claimed in claim 1, wherein the air-drying system further comprises a dehumidification module coupled to the air supply port.

17. The softgel drying machine as claimed in claim 1, further comprises a first tumbler motor coupled to the plurality of first tumblers.

18. The softgel drying machine as claimed in claim 17, further comprises a second tumbler motor coupled to the plurality of second tumblers.

19. The soft drying machine as claimed in claim 1, wherein each of the first tumbler comprises a first tumbler body and a first tumbler mesh located at the tumbler body, and each of the second tumbler comprises a second tumbler body and a second tumbler mesh located at the second tumbler body.

* * * * *